US005730785A

United States Patent [19]

Idol et al.

[11] Patent Number: 5,730,785

[45] Date of Patent: Mar. 24, 1998

[54] DESICCANT CANISTER FOR DESICCANTS AND OTHER PARTICULATE MATERIAL

[75] Inventors: Ronald C. Idol, Amherst; Joseph L. Iwaniszek, Lancaster, both of N.Y.

[73] Assignee: Multisorb Technologies, Inc., Buffalo, N.Y.

[21] Appl. No.: 41,715

[22] Filed: Apr. 1, 1993

[51] Int. Cl.[6] ..... B65D 51/16

[52] U.S. Cl. ..... 96/108; 95/90; 206/204; 220/367.1

[58] Field of Search ..... 95/90, 91; 96/108, 96/118; 206/204, 524.4; 220/307, 367.1, 601

[56] References Cited

U.S. PATENT DOCUMENTS

| | | | |
|---|---|---|---|
| 36,752 | 10/1862 | Combe . | |
| 984,352 | 2/1911 | Costello . | |
| 2,242,966 | 5/1941 | Burkhardt | 220/367 |
| 2,702,089 | 2/1955 | Engelder | 183/4.8 |
| 2,994,404 | 8/1961 | Schifferly | 96/118 |
| 3,245,737 | 4/1966 | Kleinhans | 206/204 |
| 3,436,352 | 4/1969 | Revoir et al. | 252/193 |
| 3,485,416 | 12/1969 | Fohrman | 222/142.1 |
| 3,596,694 | 8/1971 | Jaeniche | 220/307 |
| 3,820,309 | 6/1974 | Cullen et al. | 55/387 |
| 4,093,105 | 6/1978 | Russell et al. | 220/373 |
| 4,301,939 | 11/1981 | Pupp | 220/307 |
| 4,334,631 | 6/1982 | Ballester | 220/307 |
| 4,446,986 | 5/1984 | Bowen et al. | 220/307 |
| 4,691,839 | 9/1987 | Ullman | 220/307 |
| 4,770,318 | 9/1988 | Earl | 220/307 |
| 4,772,300 | 9/1988 | Cullen et al. | 55/387 |
| 4,783,206 | 11/1988 | Cullen et al. | 55/387 |
| 5,005,763 | 4/1991 | Cullen et al. | 239/57 |
| 5,092,914 | 3/1992 | Cullen et al. | 55/316 |

*Primary Examiner*—C. Scott Bushey
*Attorney, Agent, or Firm*—Joseph P. Gastel

[57] ABSTRACT

A canister for a desiccant or other particulate material including a substantially cylindrical molded plastic body having an integral end wall and an inner surface and an open end, a cap having an inner surface and a portion which enters the open end of the body and is retained therein by a bead and groove connection, desiccant in the canister, and very small apertures in the cap and end wall, the apertures diverging in diameter from the inner surfaces of the cap and end wall toward the outer surfaces thereof to thereby tend to impede passage of the desiccant out of the canister and also tend to obviate clogging of the apertures.

29 Claims, 1 Drawing Sheet

DESICCANT CANISTER FOR DESICCANTS AND OTHER PARTICULATE MATERIAL

BACKGROUND OF THE INVENTION

The present invention relates to an improved desiccant canister of the type which is utilized to adsorb moisture and odors from containers in which they are packed with other materials, such as pharmaceuticals.

By way of background, desiccant canisters are commonly used to adsorb moisture and odors in pharmaceutical containers. One such canister is shown in U.S. Pat. No. 4,093,105. In this canister, small holes are provided in a cap and in the end wall thereof. The holes have their larger openings facing the inside of the container, and they taper toward the outside surfaces of the container. These holes are of the foregoing shape to prevent the contents of the container from leaving the container because the contents would merely become jammed or wedged in the small holes. However, such a jamming could be detrimental in that the container contents could plug the holes, thereby preventing the entry of moisture and odor-causing gases. Furthermore, the prior art canister lists apertures for a 17/32 diameter container as being 0.018 inches at their larger end and 0.007 inches at their small end. The 0.018 inch dimension is relatively large and thus could readily receive particles of the desiccant within the canister.

In contrast to the dimensioning of the prior art container, it has been discovered that if the apertures in the canister are made extremely small at the inside surfaces of the container, there is practically no tendency for the desiccant to enter the apertures, and if some very small particles should by chance enter the small ends of the apertures, the fact that the apertures diverge outwardly, would permit such small particles to leave the canister, thereby obviating the clogging which could interfere with continued moisture and gas adsorption.

SUMMARY OF THE INVENTION

It is accordingly one object of the present invention to provide an improved desiccant canister which has apertures of such a small size that it is highly unlikely that particles of desiccant will enter the apertures, and if they do, they will not clog the apertures because they diverge toward the outside of the canister.

Another object of the present invention is to provide a desiccant canister in which a cap is so dimensioned relative to the remainder of the canister so that it is virtually impossible to remove it once it has been installed. Other objects and attendant advantages of the present invention will readily be perceived hereafter.

The present invention relates to a canister containing a desiccant comprising a molded plastic body, an end wall on said body having an inner surface and an outer surface, a cap having a cap wall, an inner surface and an outer surface on said cap wall, means for securing said cap on said body in opposition to said end wall, desiccant particles in said body, and apertures in at least one of said cap wall and end wall, said apertures diverging in diameter in the direction from said inner surface toward said outer surface of said wall in which they are located, and said apertures at said inner surface being of smaller size than the size of said desiccant particles.

The present invention also relates to a canister comprising a molded plastic body, an end wall on said body having an inner surface and an outer surface, a cap having a cap wall, an inner surface and an outer surface on said cap wall, means for securing said cap on said body in opposition to said end wall, and apertures in at least one of said cap wall and end wall, said apertures diverging in diameter in the direction from said inner surface toward said outer surface of said wall in which they are located.

The various aspects of the present invention will be more fully understood when the following portions of the specification are read in conjunction with the accompanying drawings wherein:

DESCRIPTION OF THE PREFERRED EMBODIMENTS

Figure 1:
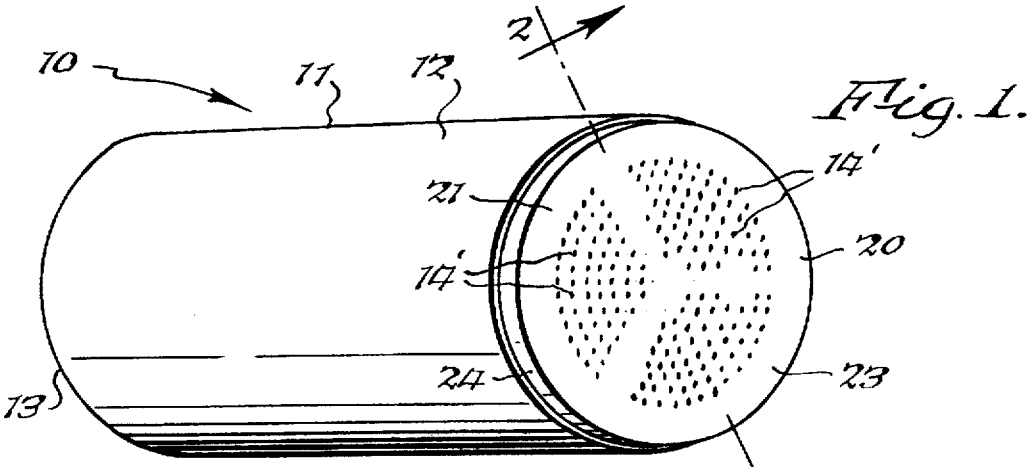
FIG. 1 is a perspective view of the improved desiccant canister of the present invention.
Figure 2:
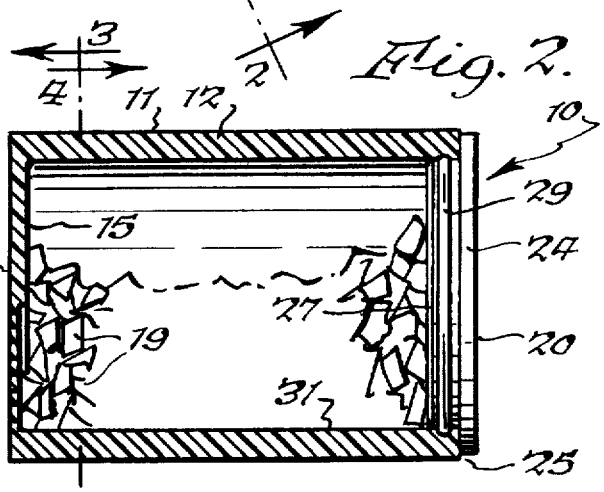
FIG. 2 is a cross sectional view taken substantially along line 2—2 of FIG. 1.
Figure 5:
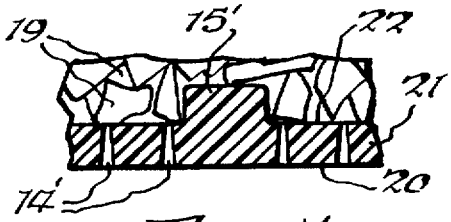
FIG. 5 is a fragmentary cross sectional view taken substantially along line 5—5 of FIG. 4.
Figure 3:
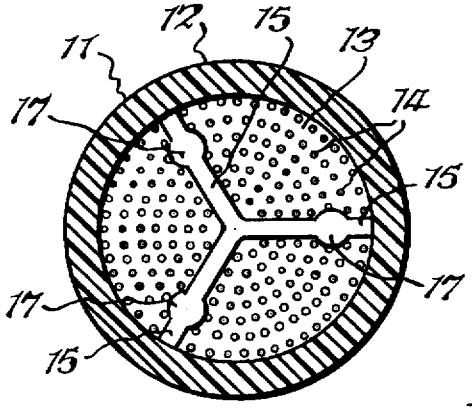
FIG. 3 is a cross sectional view taken substantially along line 3—3 of FIG. 2 and showing the end wall of the canister.
Figure 4:
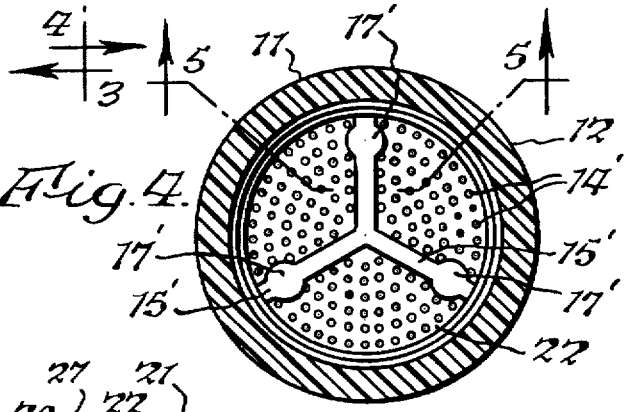
FIG. 4 is a cross sectional view taken substantially along line 4—4 of FIG. 2 and showing the cap end of the canister.

Summarizing briefly in advance, the improved desiccant canister 10 of the present invention has a plurality of uniquely integrated features which include apertures (1) which are of an extremely small size to minimize passage of particulate desiccant from the canister, and (2) which are of a shape which tends to eliminate clogging. The canister also has extreme rigidity and a cap construction which is practically impossible to remove from the body of the canister after it is once installed.

The improved canister 10 includes a body 11 having a cylindrical wall 12 and an integrally molded end wall 13. Body 11 is preferably fabricated from polyethylene. End wall 13 has a plurality of frustoconical apertures 14 therein. It also includes a plurality of ribs 15 which lend strength to end wall 13, considering the thinness of this end wall and the large number of apertures 14 therein. The ribs 15 include relatively straight portions, not numbered, and enlarged somewhat circular portions 17 which are bearing areas for the pins which are utilized to remove the body 11 from the mold in which it is formed. The portion of the end wall 13 in which the apertures are located is 0.014 inches thick and the ribs are 0.028 inches thick. The ribs, being 0.028 thick, prevent oil canning of the wall 13 and the cap wall 20. The apertures 14 at the inside of the canister are about 0.003 inches in diameter and they diverge outwardly at an angle of between about 1° and 2°. There are about 190 apertures in end wall 13, the inner surface of which is 0.459 inches in diameter, and body 11 is 0.550 inches in diameter.

The canister 10 contains a desiccant 19, in this instance particulate silica gel, having particle sizes no greater than 0.08 inches. Any other suitable desiccant may be used.

Figure 6:
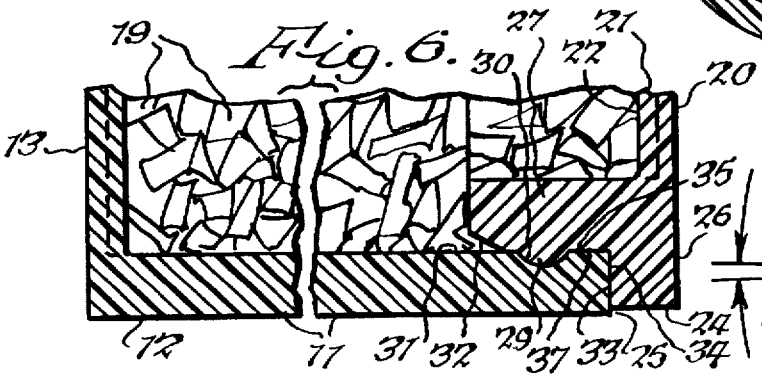
FIG. 6 is an enlarged fragmentary view of a portion of FIG. 2.
Figure 7:
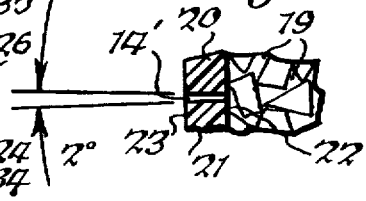
FIG. 7 is an enlarged fragmentary view showing the cross sectional contour of the apertures.

After the particulate desiccant 19 has been placed into body 11, a cap 20 is installed on body 11. Cap 20 includes wall 21 having an inner surface 22. Wall 21 includes a plurality of frustoconical apertures 14' which have the same dimensions as apertures 14 of end wall 13, namely, about 0.003 inches in diameter at inner surface 22, and they diverge outwardly between about 1° and 2° toward the outer surface 23 of wall 21. Cap 20 is made of the same material as body 11. Cap 20 includes ribs 15' with enlarged parts 17', both of which are substantially identical to ribs 15 and enlarged parts 17, respectively, of end wall 13. Cap wall 21 terminates at an outer peripheral surface 24 on annular flange 26 which is of slightly smaller diameter than body 11. See FIG. 6. Thus, flange 26 does not protrude radially outwardly beyond body 11. Thus, the edge 25 of body 11, by extending radially outwardly beyond peripheral edge 24 of flange 26, prevents the edge of cap 20 from being snagged and pulled out of body 12.

Cap 20 also includes a cylindrical portion 27 which fits into the open end of body 11 and is of a thickness which reinforces the open end of the body 11. An annular bead 29 is located on cap portion 27, and it is received in annular groove 30 on inner surface 31 of body 11. The end 32 of cap portion 11 has an annular chamfer to enhance the ease with which cap 20 may be inserted into body 11. When cap 20 is fully inserted, there will be a snap-fit between annular bead 29 and groove 30. The cap and open end of the body are dimensioned so that at this time annular surface 33 of flange 26 of cap 20 will fit snugly against annular end 34 of body 11. Furthermore, the annular edge portion 35 of internal surface 31 between end surface 34 and groove 30 is slightly longer than the annular surface 37 of cap 20 between surface 33 and bead 29. This dimensioning will cause annular cap surface 33 to fit snugly against annular end surface 34 of body 11 when bead 29 is in groove 30. In this respect, by way of example, cap surface 37 is 0.040 inches long and surface 35 of body 11 is 0.045 inches long. Thus, there is an interference fit when the cap is fully seated.

The small size 0.003 inch of the apertures 14 and 14', on the inner surfaces of end wall 13 and cap wall 20, respectively, virtuely assures a combination of both very little dusting and very little clogging. In this respect, in canisters wherein the larger diameter of the apertures faces the inside of the canister, there is a tendency for the particles of desiccant to be funneled into the apertures which results in clogging. In addition, the prior art type of apertures which have their larger dimension facing the inside of the canister, also act as funnels to funnel desiccant dust out of the canister. In contrast to this, since the smallest portions of the apertures 14 and 14' are at the inside of the canister, there is very little tendency of the desiccant to enter and thus obstruct the apertures, and, in addition, the funneling effect is obviated so that there is less tendency for desiccant dust to pass through the apertures.

While the above description has associated the canister with particulate desiccant, it will be appreciated that canister 10 can be used for other types of particulate materials which have a larger size than the apertures and which are used to adsorb, absorb or otherwise treat the environment in which the canister is located. Such materials can include products such as carbon or other materials for odor control and humectants such as hydrogel and powdered celluloses for supplying moisture, or other particulate materials for affecting the environment in which the canister is located.

While canister 10 has been shown as having an integral end wall 13 and an insertable cap 20, it will be appreciated that, if desired, the canister can have an additional cap 20 substituted for end wall 13. Also, while the canister 10 has been shown with apertures in both the end wall and the cap, it will be appreciated that the apertures can be located in either one of these parts.

While a preferred embodiment of the present invention has been disclosed, it will be appreciated that it is not limited thereto but can be otherwise embodied within the scope of the following claims.

What is claimed is:

1. A canister containing a desiccant comprising a molded plastic body, an end wall on said body having an inner surface and an outer surface, a molded plastic cap having a cap wall, an inner surface and an outer surface on said cap wall, means for securing said cap on said body in opposition to said end wall, desiccant particles in said body, at least one of said wall and said cap wall having an inner surface which is substantially planar, and apertures in at least one of said cap wall and end wall, said apertures terminating at said substantially planar inner surface and diverging in diameter in the direction from said inner surface toward said outer surface of said wall in which they are located, and said apertures at said inner surface being of smaller size than the size of said desiccant particles.

2. A canister as set forth in claim 1 wherein said apertures are in both said end wall and said cap wall.

3. A canister as set forth in claim 1 wherein said end wall is a molded integral part of said molded plastic body.

4. A canister as set forth in claim 3 wherein said apertures are in both said end wall and said cap wall.

5. A canister as set forth in claim 1 wherein said body at the opposite end thereof from said end wall terminates at an end surface surrounding an opening, and wherein said body includes an inner surface, and wherein said cap covers said opening, said cap comprising a first portion which is inserted into said body through said opening, a flange on said cap of larger diameter than said first portion of said cap, a flange surface on said flange for abutting said end surface, and interengaging means between said inner surface of said body and said first portion of said cap for securing said cap on said body.

6. A canister as set forth in claim 5 wherein said body is substantially cylindrical, and wherein said first portion of said cap is cylindrical, and wherein said interengaging means comprise a bead and groove connection.

7. A canister as set forth in claim 6 wherein said bead and groove connection comprises an annular bead on said first portion of said cap, and an annular groove in said inner surface of said body.

8. A canister as set forth in claim 5 wherein said body is substantially cylindrical and wherein said flange is substantially cylindrical, and wherein said flange is of slightly less diameter than the diameter of said body.

9. A canister as set forth in claim 8 wherein said first portion is cylindrical, and wherein said interengaging means comprise a bead and groove connection.

10. A canister as set forth in claim 9 wherein said bead and groove connection comprises an annular bead on said first portion, and an annular groove in said inner surface of said body.

11. A canister as set forth in claim 5 wherein said first portion of said cap is of substantial thickness to reinforce said body proximate said opening.

12. A canister comprising a molded plastic body, an end wall on said body having an inner surface and an outer surface, a molded plastic cap having a cap wall, an inner surface and an outer surface on said cap wall, means for securing said cap on said body in opposition to said end wall, at least one of said end wall and said cap wall having an inner surface which is substantially planar, and apertures in at least one of said cap wall and end wall, said apertures terminating at said substantially planar inner surface and diverging in diameter in the direction from said inner surface toward said outer surface of said wall in which they are located.

13. A canister as set forth in claim 12 wherein said apertures are in both said end wall and said cap wall.

14. A canister as set forth in claim 12 wherein said body at the opposite end thereof from said end wall terminates at an end surface surrounding an opening, and wherein said body includes an inner surface, and wherein said cap covers said opening, said cap comprising a first portion which is inserted into said body through said opening, a flange on said cap of larger diameter than said first portion of said cap, a flange surface on said flange for abutting said end surface, and interengaging means between said inner surface of said body and said first portion of said cap for securing said cap on said body.

15. A canister as set forth in claim 14 wherein said body is substantially cylindrical, and wherein said first portion of said cap is cylindrical, and wherein said interengaging means comprise a bead and groove connection.

16. A canister as set forth in claim 15 wherein said bead and groove connection comprises an annular bead on said first portion of said cap, and an annular groove in said inner surface of said body.

17. A canister as set forth in claim 12 wherein said body is substantially cylindrical and wherein said flange is substantially cylindrical, and wherein said flange is of slightly less diameter than the diameter of said body.

18. A canister containing a desiccant comprising a molded plastic body, an end wall on said body having an inner surface and an outer surface, a cap having a cap wall, an inner surface and an outer surface on said cap wall, means for securing said cap on said body in opposition to said end wall, desiccant particles in said body, and apertures in at least one of said cap wall and end wall, said apertures diverging in diameter in the direction from said inner surface toward said outer surface of said wall in which they are located, said apertures at said inner surface being of smaller size than the size of said desiccant particles, and said diameter of said apertures at said inner surface being of a size of about 0.003 inches.

19. A canister containing a desiccant comprising a molded plastic body, an end wall on said body having an inner surface and an outer surface, a cap having a cap wall, an inner surface and an outer surface on said cap wall, means for securing said cap on said body in opposition to said end wall, desiccant particles in said body, and apertures in at least one of said cap wall and end wall, said apertures diverging in diameter in the direction from said inner surface toward said outer surface of said wall in which they are located, said apertures at said inner surface being of smaller size than the size of said desiccant particles, and said apertures being frustoconical and diverging in an amount of between about one and two degrees.

20. A canister as set forth in claim 19 wherein said apertures are in both said end wall and cap wall.

21. A canister containing a desiccant comprising a molded plastic body, an end wall on said body having an inner surface and an outer surface, a cap having a cap wall, an inner surface and an outer surface on said cap wall, means for securing said cap on said body in opposition to said end wall, desiccant particles in said body, and apertures in both said cap wall and end wall, said apertures diverging in diameter in the direction from said inner surface toward said outer surface of said wall in which they are located, said apertures at said inner surface being of smaller size than the size of said desiccant particles, and said diameter of said apertures at said inner surface being of a size of about 0.003 inches.

22. A canister as set forth in claim 21 wherein said apertures are frustoconical and diverge in an amount of between about one and two degrees.

23. A canister containing a desiccant comprising a molded plastic body, an end wall on said body having an inner surface and an outer surface, a cap having a cap wall, an inner surface and an outer surface on said cap wall, means for securing said cap on said body in opposition to said end wall, desiccant particles in said body, and apertures in both said cap wall and end wall, said apertures diverging in diameter in the direction from said inner surface toward said outer surface of said wall in which they are located, said apertures at said inner surface being of smaller size than the size of said desiccant particles, said end wall being a molded integral part of said molded plastic body, and said apertures being frustoconical and diverging in an amount of between about one and two degrees.

24. A canister as set forth in claim 23 wherein said diameter of said apertures at said inner surface is of a size of about 0.003 inches.

25. A canister containing a desiccant comprising a molded plastic body, an end wall on said body having an inner surface and an outer surface, a cap having a cap wall, an inner surface and an outer surface on said cap wall, means for securing said cap on said body in opposition to said end wall, desiccant particles in said body, and apertures in at least one of said cap wall and end wall, said apertures diverging in diameter in the direction from said inner surface toward said outer surface of said wall in which they are located, said apertures at said inner surface being of smaller size than the size of said desiccant particles, said body at the opposite end thereof from said end wall terminating at an end surface surrounding an opening, and said body including an inner surface, and said cap covering said opening, said cap comprising a first portion which is inserted into said body through said opening, a flange on said cap of larger diameter than said first portion of said cap, a flange surface on said flange for abutting said end surface, a bead and groove connection between said inner surface of said body and said first portion of said cap for securing said cap on said body, said body being substantially cylindrical, and said first portion of said cap being cylindrical, said bead and groove connection comprising an annular bead on said first portion of said cap, an annular groove in said inner surface of said body, said inner surface of said body including an inner surface portion which extends axially between said groove and said end surface of said body, and said first portion of said cap including a cap surface which extends axially between said bead and said flange, and said inner surface portion of said body being of slightly longer axial length than the axial length of said cap surface to thereby cause said flange to be seated in firm abutting engagement with said end surface of said body when said bead is located in said groove.

26. A canister containing a desiccant comprising a molded plastic body, an end wall on said body having an inner surface and an outer surface, a cap having a cap wall, an inner surface and an outer surface on said cap wall, means for securing said cap on said body in opposition to said end wall, desiccant particles in said body, and apertures in at least one of said cap wall and end wall, said apertures diverging in diameter in the direction from said inner surface toward said outer surface of said wall in which they are located, said apertures at said inner surface being of smaller size than the size of said desiccant particles, said body at the opposite end thereof from said end wall terminating at an end surface surrounding an opening, and said body including an inner surface, and said cap covering said opening, said cap comprising a first portion which is inserted into said body through said opening, a flange on said cap of larger diameter than said first portion of said cap, a flange surface on said flange for abutting said end surface, a bead and groove connection between said inner surface of said body and said first portion of said cap for securing said cap on said body, said body being substantially cylindrical and said flange being substantially cylindrical, and said flange being of slightly less diameter than the diameter of said body, said first portion being cylindrical, said bead and groove connection comprising an annular bead on said first portion, and an annular groove in said inner surface of said body, said inner surface of said body including an inner surface portion which extends axially between said groove and said end surface of said body, and said first portion of said cap including a cap surface which extends axially between said bead and said flange, and said inner surface portion of said body being of slightly longer axial length than the axial length of said cap surface to thereby cause said flange to be seated in firm abutting engagement with said end surface of said body when said bead is located in said groove.

27. A canister comprising a molded plastic body, an end wall on said body having an inner surface and an outer surface, a cap having a cap wall, an inner surface and an outer surface on said cap wall, means for securing said cap on said body in opposition to said end wall, and apertures in both said cap wall and end wall, said apertures diverging in diameter in the direction from said inner surface toward said outer surface of said wall in which they are located, and said apertures being frustoconical and diverging in an amount of between about one and two degrees.

28. A canister comprising a molded plastic body, an end wall on said body having an inner surface and an outer surface, a cap having a cap wall, an inner surface and an outer surface on said cap wall, means for securing said cap on said body in opposition to said end wall, and apertures in at least one of said cap wall and end wall, said apertures diverging in diameter in the direction from said inner surface toward said outer surface of said wall in which they are located, and said apertures being frustoconical and diverging in an amount of between about one and two degrees.

29. A canister comprising a molded plastic body, an end wall on said body having an inner surface and an outer surface, a cap having a cap wall, an inner surface and an outer surface on said cap wall, means for securing said cap on said body in opposition to said end wall, and apertures in at least one of said cap wall and end wall, said apertures diverging in diameter in the direction from said inner surface toward said outer surface of said wall in which they are located, said body at the opposite end thereof from said end wall terminating at an end surface surrounding an opening, and said body including an inner surface, and said cap covering said opening, said cap comprising a first portion which is inserted into said body through said opening, a flange on said cap of larger diameter than said first portion of said cap, a flange surface on said flange for abutting said end surface, a bead and groove connection between said inner surface of said body and said first portion of said cap for securing said cap on said body, said body being substantially cylindrical, and said first portion of said cap being cylindrical, said bead and groove connection comprising an annular bead on said first portion of said cap, and an annular groove in said inner surface of said body, said inner surface of said body including an inner surface portion which extends axially between said groove and said end surface of said body, and said first portion of said cap including a cap surface which extends axially between said bead and said flange, and said inner surface portion of said body being of slightly longer axial length than the axial length of said cap surface to thereby cause said flange to be seated in firm abutting engagement with said end surface of said body when said bead is located in said groove.

* * * * *

UNITED STATES PATENT AND TRADEMARK OFFICE

CERTIFICATE OF CORRECTION

PATENT NO. : 5,730,785

DATED : March 24, 1998

INVENTOR(S) : Ronald C. Idol et al

It is certified that error appears in the above-identified patent and that said Letters Patent is hereby corrected as shown below:

Column 4, line 12 (claim 1), before "wall" (first occurrence) insert --end--.

Signed and Sealed this

Twenty-sixth Day of May, 1998

*Attest:*

Bruce Lehman

BRUCE LEHMAN

*Attesting Officer*

*Commissioner of Patents and Trademarks*